US009411288B2

(12) United States Patent
Isoda

(10) Patent No.: US 9,411,288 B2
(45) Date of Patent: Aug. 9, 2016

(54) TONER DETECTION SENSOR AND IMAGE FORMING APPARATUS

(71) Applicant: KYOCERA Document Solutions Inc., Osaka-shi, Osaka (JP)

(72) Inventor: Keisuke Isoda, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days.

(21) Appl. No.: 14/948,424

(22) Filed: Nov. 23, 2015

(65) Prior Publication Data

US 2016/0147177 A1 May 26, 2016

(30) Foreign Application Priority Data

Nov. 26, 2014 (JP) ..... 2014-239124

(51) Int. Cl.
*G03G 15/08* (2006.01)
*G03G 15/00* (2006.01)

(52) U.S. Cl.
CPC ..... *G03G 15/5041* (2013.01); *G03G 15/0827* (2013.01); *G03G 15/556* (2013.01); *G03G 2215/00042* (2013.01); *G03G 2215/00616* (2013.01)

(58) Field of Classification Search
CPC ..... G03G 15/0827; G03G 15/0855; G03G 15/5041; G03G 15/5062; G03G 15/556; G03G 2215/00042; G03G 2215/00059; G03G 2215/00616; G03G 2215/0062
USPC ..... 399/49, 66, 299, 302, 308
See application file for complete search history.

(56) References Cited

U.S. PATENT DOCUMENTS 4,950,905 A * 8/1990 Butler ..... G01N 21/474 250/341.8
5,630,195 A * 5/1997 Sawayama ..... G03G 15/0855 399/49
7,655,936 B2 * 2/2010 Sawayama ..... G01N 21/55 250/559.4
7,676,169 B2 * 3/2010 Denton ..... G03G 15/5062 399/49
8,918,005 B2 * 12/2014 Ogata ..... H04N 5/335 356/445
2009/0297191 A1 * 12/2009 Hirai ..... G03G 15/1605 399/49

FOREIGN PATENT DOCUMENTS

JP H10-281991 A 10/1998
JP 11160927 A * 6/1999

(Continued)

*Primary Examiner* — Robert Beatty

(57) ABSTRACT

A toner-amount detection sensor includes a light-emitting element, a first light-receiving element, and a toner-amount calculating unit. The light-emitting element emits light toward the surface of the transfer body at a predetermined incident angle. The first light-receiving element is disposed on a side opposite to the light-emitting element with respect to a plane normal to the surface of the transfer body. The first light-receiving element receives light reflected from the surface of the transfer body. The toner-amount calculating unit calculates the amount of toner from the quantity of the reflected light received by the first light-receiving element. The sensor has a relationship of $A_1<A_2<1.5A_1$ where $A_1$ represents the predetermined incident angle with respect to the plane normal to the surface of the transfer body, and $A_2$ represents an angle of disposition of the first light-receiving element with respect to the plane normal to the surface of the transfer body.

6 Claims, 5 Drawing Sheets

(56) References Cited

FOREIGN PATENT DOCUMENTS

| | | | | |
|---|---|---|---|---|
| JP | 2000250304 | A | * | 9/2000 |
| JP | 2003279472 | A | * | 10/2003 |
| JP | 2004333794 | A | * | 11/2004 |
| JP | 2011-170165 | A | | 9/2011 |
| JP | 2013186282 | A | * | 9/2013 |

* cited by examiner

TONER DETECTION SENSOR AND IMAGE FORMING APPARATUS

INCORPORATION BY REFERENCE

The disclosure of Japanese Patent Application No. 2014-239124 filed on Nov. 26, 2014 including the specification, drawings and abstract is incorporated herein by reference in its entirety.

BACKGROUND

The present disclosure relates to toner detection sensors and image forming apparatuses.

In image forming apparatuses typified by a digital multifunctional peripheral and the like, an image of a document is read by an image reading unit, and a photoreceptor included in an image forming unit is irradiated with light based on the read image, whereby an electrostatic latent image is formed on the photoreceptor. Thereafter, a developer such as charged toner is supplied onto the electrostatic latent image to form a visible image, which is transferred and fixed onto a sheet of paper fed. The sheet is then discharged to the outside of the apparatus.

Image forming apparatuses capable of forming full-color images include those which form a full-color image by overlaying images of respective colors of yellow, cyan, magenta, and black on one another. In this case, toner images of the respective colors are once transferred onto a transfer belt as an intermediate transfer body, and the resultant full-color image is transferred onto a sheet of paper. When forming a full-color image, it is necessary to perform corrections at certain timings so as to maintain high levels of color developing property and color reproducibility. In such corrections, the amount of toner on the transfer body is detected, and the developing bias value, the amount of exposure, the timing of exposure and so on are adjusted to achieve a proper amount of toner.

Techniques regarding the sensors which detect the amount of toner are conventionally known.

A typical gloss sensor is disclosed, in which a projector emits measurement light having a predetermined incident angle onto an object surface, and light reflected from the object surface is measured by a light receiver at the same angle as the incident angle, to measure the glossiness. In this gloss sensor, the projector emits light of a single wavelength. The projector is provided with a polarizer, through which the light is directed onto the object surface as polarized light in one direction. Light reflected from the object surface is transmitted through a polarization beam splitter, where the light is separated into a reflected light component having the polarized light in the same direction as the measurement light and a reflected light component in a different direction. The reflected light components are received by light-receiving means provided respectively for these components, and the outputs from the two light-receiving means are computed to thereby measure the glossiness.

A typical image forming apparatus is disclosed, which includes a recording medium conveyance belt rotatably stretched over a plurality of roller members. In this apparatus, at least one specular reflection detection type optical sensor and at least one specular reflection/diffuse reflection simultaneous detection type optical sensor are disposed to face an intermediate transfer body, and at least one specular reflection detection type optical sensor is disposed to face the recording medium conveyance belt or a second image carrier. In this apparatus, the at least one specular reflection detection type optical sensor disposed to face the recording medium conveyance belt or the second image carrier is used for black toner adhesion amount control, while the at least one specular reflection/diffuse reflection simultaneous detection type optical sensor disposed to face the intermediate transfer body is used for remaining color toner adhesion amount control. Further, in this apparatus, the at least one specular reflection/diffuse reflection simultaneous detection type optical sensor and the at least one specular reflection detection type optical sensor disposed to face the intermediate transfer body are used for color alignment control.

SUMMARY

In an aspect of the present disclosure, a toner-amount detection sensor detects the amount of toner of a toner visible image formed on a surface of a transfer body. The toner-amount detection sensor includes a light-emitting element, a first light-receiving element, and a toner-amount calculating unit. The light-emitting element emits light toward the surface of the transfer body at a predetermined incident angle. The first light-receiving element is disposed on a side opposite to the light-emitting element with respect to a plane normal to the surface of the transfer body. The first light-receiving element receives light reflected from the surface of the transfer body. The toner-amount calculating unit calculates the amount of toner from the quantity of the reflected light received by the first light-receiving element. The sensor has a relationship of $A_1<A_2<1.5A_1$ where $A_1$ represents the predetermined incident angle with respect to the plane normal to the surface of the transfer body, and $A_2$ represents an angle of disposition of the first light-receiving element with respect to the plane normal to the surface of the transfer body.

In another aspect of the present disclosure, an image forming apparatus includes an image forming unit which forms a visible image with toner and includes a toner-amount detection sensor for detecting the amount of toner of the toner visible image formed on a surface of a transfer body. The toner-amount detection sensor includes a light-emitting element, a first light-receiving element, and a toner-amount calculating unit. The light-emitting element emits light toward the surface of the transfer body at a predetermined incident angle. The first light-receiving element is disposed on a side opposite to the light-emitting element with respect to a plane normal to the surface of the transfer body. The first light-receiving element receives light reflected from the surface of the transfer body. The toner-amount calculating unit calculates the amount of toner from the quantity of the reflected light received by the first light-receiving element. The sensor has a relationship of $A_1<A_2<1.5A_1$ where $A_1$ represents the predetermined incident angle with respect to the plane normal to the surface of the transfer body, and $A_2$ represents an angle of disposition of the first light-receiving element with respect to the plane normal to the surface of the transfer body.

DETAILED DESCRIPTION

Figure 1:
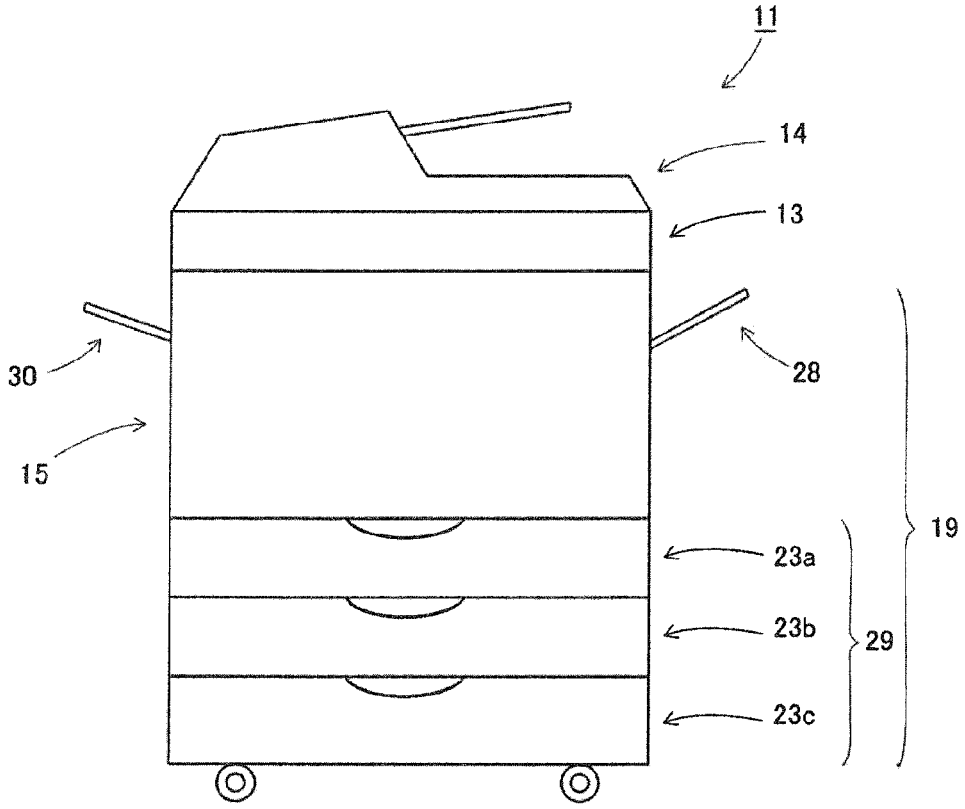
FIG. 1 schematically shows an appearance of a digital multifunctional peripheral in the case where an image forming apparatus according to an embodiment of the present disclosure is applied to the digital multifunctional peripheral.
Figure 2:
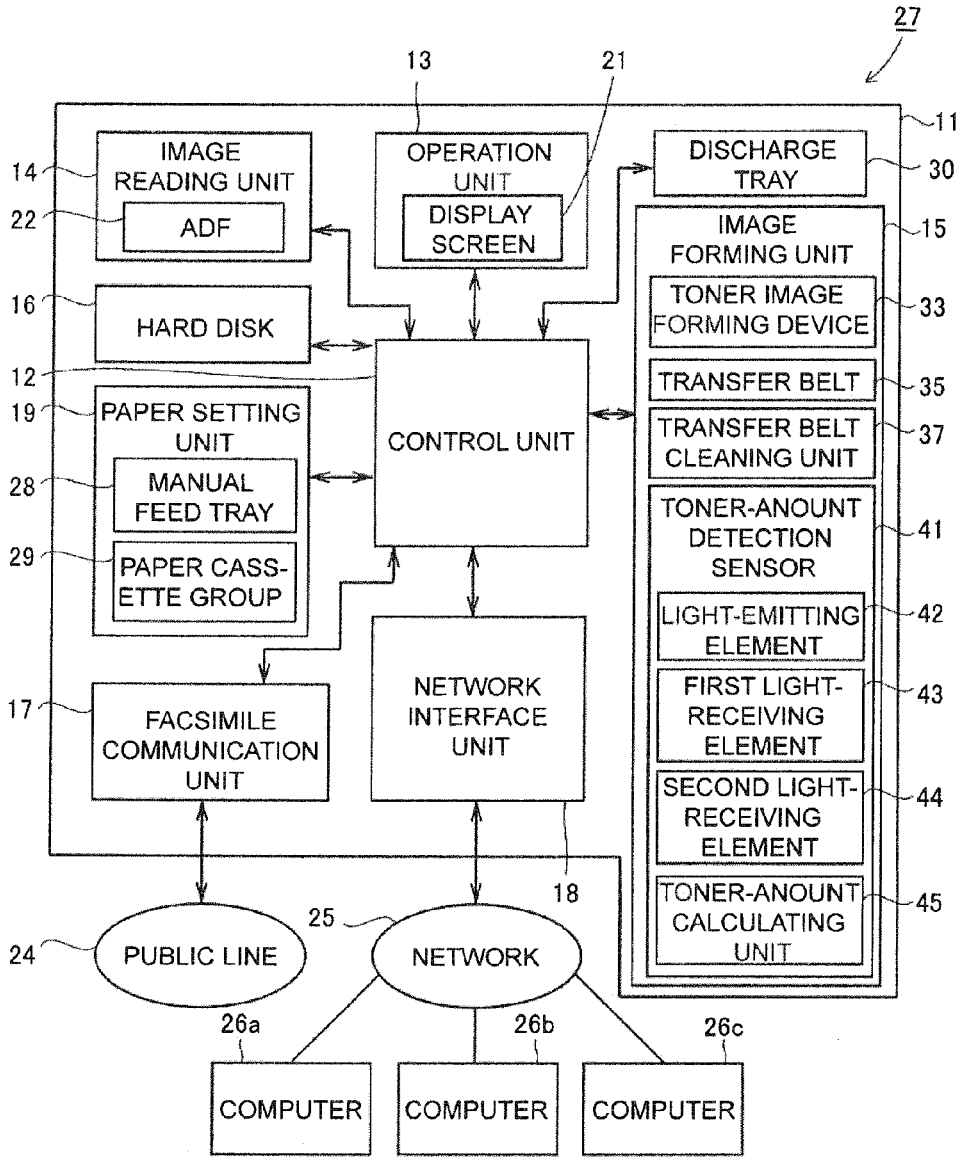
FIG. 2 is a block diagram showing the configuration of the digital multifunctional peripheral in the case where the image forming apparatus according to the embodiment of the present disclosure is applied to the digital multifunctional peripheral.

Embodiments of the present disclosure will be described below. First, the configuration of a digital multifunctional peripheral in the case where an image forming apparatus according to an embodiment of the present disclosure is applied to the digital multifunctional peripheral will be described. FIG. 1 schematically shows an appearance of the digital multifunctional peripheral. FIG. 2 is a block diagram showing the configuration of the digital multifunctional peripheral.

Referring to FIGS. 1 and 2, the digital multifunctional peripheral 11 includes: a control unit 12; an operation unit 13; an image reading unit 14; a paper setting unit 19; an image forming unit 15; a discharge tray 30; a hard disk 16; a facsimile communication unit 17; and a network interface unit 18 for connecting with a network 25. The control unit 12 is responsible for overall control of the digital multifunctional peripheral 11. The operation unit 13 includes a display screen 21 for displaying information originated from the digital multifunctional peripheral 11 side and content input by a user. The operation unit 13 causes a user to set image forming conditions, such as the number of copies and gradation, and to turn the power on or off. The image reading unit 14 includes an auto document feeder (ADF) 22 which automatically feeds a document that has been set, to a reading section. The image reading unit 14 reads an image of a document. The paper setting unit 19 includes a manual feed tray 28 allowing a user to manually set a sheet thereon, and a paper cassette group 29 capable of storing sheets of paper different in size. One or more sheets of paper to be supplied to the image forming unit 15 are set on the paper setting unit 19. The image forming unit 15 forms an image on the basis of image data of the read image or on the basis of image data received via the network 25. The sheet of paper on which an image has been formed by the image forming unit 15 is discharged onto the discharge tray 30. The hard disk 16 stores, among others, the image data received, and the image forming conditions input. The facsimile communication unit 17, which is connected to a public line 24, performs facsimile transmission and reception. Although the digital multifunctional peripheral 11 further includes a dynamic random access memory (DRAM) to and from which image data is written and read, and other components, the illustration and description thereof will be omitted. The arrows in FIG. 2 indicate flows of control signals as well as data related to control and images. In the present embodiment, as shown in FIG. 1, the paper cassette group 29 is composed of three paper cassettes 23*a*, 23*b*, and 23*c*.

The digital multifunctional peripheral 11 operates as a copier by forming an image in the image forming unit 15 using the image data of the document read by the image reading unit 14. The digital multifunctional peripheral 11 operates as a printer by forming an image and printing the image on a sheet of paper in the image forming unit 15 using image data received from a computer 26*a*, 26*b*, 26*c* connected to the network 25, via the network interface unit 18. That is, the image forming unit 15 operates as the printing unit which prints a requested image. Further, the digital multifunctional peripheral 11 operates as a facsimile machine by forming an image in the image forming unit 15 via the DRAM using the image data received from the public line 24 through the facsimile communication unit 17, or by transmitting the image data of the document read by the image reading unit 14 to the public line 24 through the facsimile communication unit 17. As such, the digital multifunctional peripheral 11 has a plurality of functions related to image processing, such as a copying function, function as a printer, facsimile function, etc. The digital multifunctional peripheral 11 further has a function enabling detailed settings for each of the above functions.

An image forming system 27 according to an embodiment of the present disclosure includes the digital multifunctional peripheral 11 having the above-described configuration, and a plurality of computers 26*a*, 26*b*, 26*c* connected to the digital multifunctional peripheral 11 via the network 25. In this embodiment, three computers 26*a*-26*c* are shown by way of example. Each of the computers 26*a*-26*c* is able to issue a print request to the digital multifunctional peripheral 11 via the network 25 for printing. The digital multifunctional peripheral 11 and the computers 26*a*-26*c* may be connected via wire using a local area network (LAN) cable or the like, or they may be connected wirelessly. Another digital multifunctional peripheral or a server may be connected in the network 25.

Figure 3:
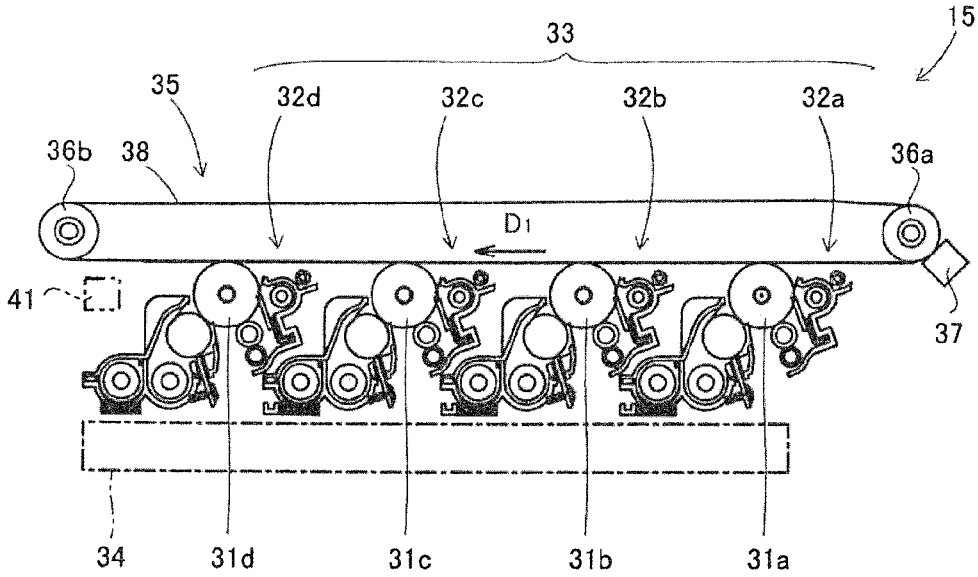
FIG. 3 is an appearance diagram schematically showing the configuration of an image forming unit.

The configuration of the image forming unit 15 included in the digital multifunctional peripheral 11 will be described below in more detail. FIG. 3 is a cross-sectional view showing the schematic configuration of the digital multifunctional peripheral 11 according to an embodiment of the present disclosure. In FIG. 3, the hatching of the members are omitted for ease of understanding. FIG. 3 shows the cross-sectional view of the digital multifunctional peripheral 11 taken along a plane that extends in the up-and-down direction.

Referring to FIG. 3, the image forming unit 15 includes a toner image forming device 33 which includes four toner image forming units 32*a*, 32*b*, 32*c*, and 32*d* corresponding respectively to four colors of yellow, magenta, cyan, and black and including photoreceptors 31*a*, 31*b*, 31*c*, and 31*d*, respectively. The image forming unit 15 also includes a laser scanner unit (LSU) 34 which exposes the four toner image forming units 32*a*-32*d* to light on the basis of the image read by the image reading unit 14, a transfer belt 35 as the intermediate transfer body to which the toner visible images formed by the toner image forming units 32*a*-32*d* are temporarily transferred before being transferred onto a sheet, and a transfer belt cleaning unit 37 which uses a blade or the like to remove any toner remaining on the transfer belt 35. The LSU 34 is shown schematically with a dot chain line. The transfer belt cleaning unit 37 is also shown schematically. The image forming unit 15 is a so-called four-unit tandem type developing system.

The transfer belt 35 is endless, and the visible images formed by the yellow, magenta, cyan, and black toner image forming units 32*a*-32*d* are transferred onto the transfer belt 35 as it rotates in one direction by a driving roller 36*b* and a driven roller 36*a*. The rotational direction of the transfer belt 35 is shown by an arrow $D_1$ in FIG. 3. Of the toner image forming units 32*a*-32*d*, the yellow toner image forming unit 32*a* is disposed most upstream and the black toner image forming unit 32*d* is disposed most downstream in the rotational direction of the transfer belt 35. The transfer belt cleaning unit 37 is disposed upstream of the yellow toner image forming unit 32*a*.

The toner visible images transferred on the transfer belt 35 are transferred onto a sheet fed, and fixed onto the sheet by a fixing unit (not shown). The sheet with the image fixed thereon is discharged to the outside of the digital multifunctional peripheral 11, specifically onto the discharge tray 30. After the toner visible images are transferred onto the sheet, any toner remaining on the transfer belt 35 is removed by the transfer belt cleaning unit 37. The process of forming a next image is then carried out.

The digital multifunctional peripheral 11 is capable of monochrome printing using only the black toner image forming unit 32*d*. The digital multifunctional peripheral 11 is also capable of color printing using at least one of the yellow toner image forming unit 32*a*, the magenta toner image forming unit 32*b*, and the cyan toner image forming unit 32*c*.

Here, the control unit 12 included in the digital multifunctional peripheral 11 performs corrections on the densities, positions, and color shifts of the visible images formed on the transfer belt 35 by the toner image forming units 32*a*-32*d*, at the timing when the number of printed sheets has reached a predetermined number, specifically once per every 1000 sheets of printed images, at the timing when the drive time has reached a predetermined time, and further at the timing when the environment has changed, specifically when the temperature or humidity has changed abruptly, as well as at the timing when a part of the units constituting the digital multifunctional peripheral 11 is replaced. At the time of regular maintenance, for example, the image forming unit 15 forms patch images on the transfer belt 35 for use in correcting the toner visible images. The image forming unit 15 uses the patch images to change, among others, the amounts of toner to be applied to the transfer belt 35 and the timing and intensity of laser light to be emitted by the LSU 34, thereby adjusting and correcting the toner densities, color shifts, and the like. It should be noted that the patch images formed are not transferred onto a sheet; they are removed from the surface 38 of the transfer belt 35 by the transfer belt cleaning unit 37.

For such corrections, a toner-amount detection sensor is used which detects the amount of toner of a patch image formed on the transfer belt 35. That is, the image forming unit 15 includes the toner-amount detection sensor 41 which measures the amount of toner of a toner visible image transferred onto the transfer belt 35.

Figure 4:
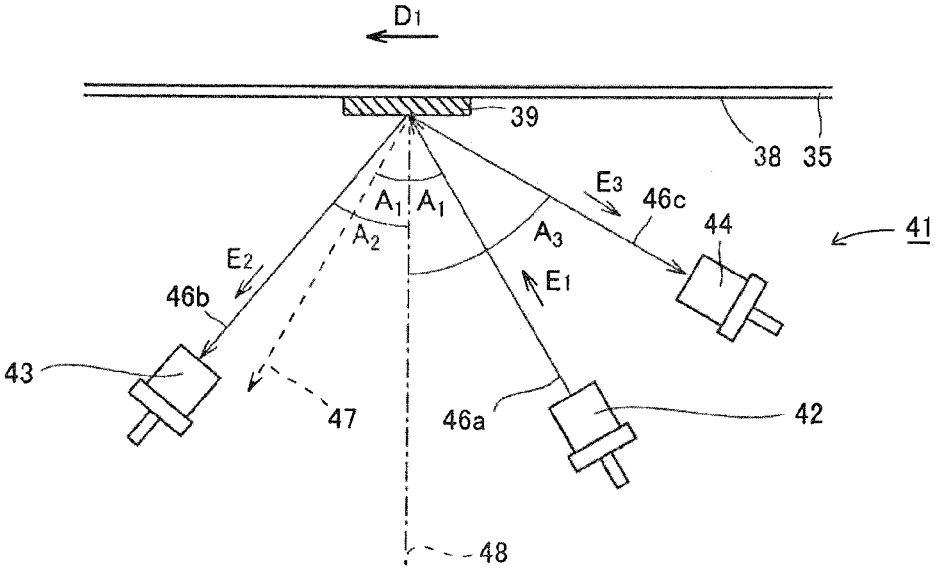
FIG. 4 is an appearance diagram schematically showing the configuration of a toner-amount detection sensor according to an embodiment of the present disclosure.

A description will now be made about the configuration of the toner-amount detection sensor 41 according to an embodiment of the present disclosure. FIG. 4 schematically shows the configuration of the toner-amount detection sensor 41 of the embodiment. In FIG. 3, the toner-amount detection sensor 41 is shown schematically with a two-dot chain line.

Referring to FIGS. 1 to 4, the toner-amount detection sensor 41 is disposed downstream of the black toner image forming unit 32*d*. The toner-amount detection sensor 41 includes: a light-emitting element 42 which emits light toward the transfer belt 35; a first light-receiving element 43 which receives light reflected from the surface 38 of the transfer belt 35; a second light-receiving element 44 which is provided separately from the first light-receiving element 43 and receives light reflected from the surface 38 of the transfer belt 35; and a toner-amount calculating unit 45 which calculates the amount of toner from the quantities of the reflected light received by the first light-receiving element 43 and the second light-receiving element 44. As an example of the light-emitting element 42, an infrared light-emitting diode, for example, is adopted. As an example of the first light-receiving element 43 and the second light-receiving element 44, infrared light-receiving elements, for example, are adopted.

The light-emitting element 42 emits light 46*a*, such as infrared light, in a diagonally upper left direction shown by an arrow $E_1$ in FIG. 4, toward the surface 38 of the transfer belt 35 or a toner visible image 39 thereon. The light 46*a* is emitted at an incident angle $A_1$ shown in FIG. 4. This angle $A_1$ is an angle made between a plane 48 normal to the surface 38 of the transfer belt 35, indicated by a dot chain line in FIG. 4, and the irradiation direction of the light 46*a*. In the present embodiment, the angle $A_1$ is also the angle of disposition of the light-emitting element 42 with respect to the plane 48. It is preferable that the angle $A_1$ is relatively small, from the standpoint of making as small as possible the changes of the output values from the first and second light-emitting elements 43 and 44 with respect to the change in distance between the light-emitting element 42 and the object to be measured. For example, the angle $A_1$ preferably falls within the range of at least 10° and less than 12°, and specifically it is set to 11°.

The first light-receiving element 43 is disposed on a side opposite to the light-emitting element 42 with respect to the plane 48 normal to the surface 38 of the transfer belt 35. The first light-receiving element 43 receives light 46*b* which is reflected at an angle close to the specular reflection angle from either one or both of the toner visible image 39 and the surface 38 of the transfer belt 35, in a diagonally lower left direction indicated by an arrow $E_2$ in FIG. 4. In the case where the toner visible image 39 completely covers the surface 38 of the transfer belt 35, the light 46*b* reflected from the toner visible image 39 alone is received. In the case where no toner visible image 39 has been formed on the surface 38 of the transfer belt 35, the light 46*b* reflected from the surface 38 of the transfer belt 35 alone is received. In the case where the toner visible image 39 has not completely covered the surface 38 of the transfer belt 35 and the amount of toner of the toner visible image 39 is small, then the light 46*b* reflected from both the toner visible image 39 and the surface 38 of the transfer belt 35 is received. The light 46*b* is received at an angle $A_2$ shown in FIG. 4. In the present embodiment, the angle $A_2$ is an angle of disposition of the first light-receiving element 43 with respect to the plane 48. The direction of specular reflection, which is reflected specularly at the angle $A_1$, is indicated by a broken line 47 for reference.

The second light-receiving element 44 is disposed on the same side as the light-emitting element 42 with respect to the plane 48 normal to the surface 38 of the transfer belt 35. The second light-receiving element 44 receives diffuse reflection light 46*c* from either one or both of the toner visible image 39 and the surface 38 of the transfer belt 35, in a diagonally lower right direction indicated by an arrow $E_3$ in FIG. 4. In the case where the toner visible image 39 completely covers the surface 38 of the transfer belt 35, the diffuse reflection light 46*c* from the toner visible image 39 alone is received. In the case where no toner visible image 39 has been formed on the surface 38 of the transfer belt 35, the diffuse reflection light 46*c* from the surface 38 of the transfer belt 35 alone is received. In the case where the toner visible image 39 has not completely covered the surface 38 of the transfer belt 35 and the amount of toner of the toner visible image 39 is small, then the diffuse reflection light 46*c* from both the toner visible image 39 and the surface 38 of the transfer belt 35 is received. The diffuse reflection light 46*c* is received at an angle $A_3$ shown in FIG. 4. In the present embodiment, the angle $A_3$ is an angle of disposition of the second light-receiving element 44 with respect to the plane 48.

The toner-amount detection sensor 41 irradiates the transfer belt 35 having a toner visible image 39 formed on its surface 38 with light 46*a* in the direction shown by the arrow $E_1$ in FIG. 4. The light 46*a* impinges on and is reflected from either one or both of the toner visible image 39 and the surface 38 of the transfer belt 35. Of the reflected light, light 46*b* reflected at an angle close to the specular reflection angle is received by the first light-receiving element 43 disposed at the angle $A_2$ with respect to the plane 48. Of the reflected light, diffuse reflection light is received by the second light-receiving element 44 disposed at the angle $A_3$ with respect to the plane 48. The first light-receiving element 43 and the second light-receiving element 44 each output a current according to the quantity of the received light. The toner-amount calculating unit 45 converts the respective currents output from the first light-receiving element 43 and the second light-receiving element 44 into voltages, and calculates the amount of toner on the basis of those voltage values. In this manner, the toner-amount detection sensor 41 detects the amount of toner.

Here, the sensor is configured to have a relationship of $A_1<A_2<1.5A_1$ where $A_1$ represents a predetermined incident angle with respect to the plane 48 normal to the surface 38 of the transfer belt 35, and $A_2$ represents the angle of disposition of the first light-receiving element 43 with respect to the plane 48 normal to the surface 38 of the transfer belt 35. It is preferable that the angle $A_2$ falls within the range of at least 12° and less than 18°, and it is set to 13°, for example.

The sensor is also configured to have a relationship of $A_3>A_1$ where $A_3$ represents the angle of disposition of the second light-receiving element 44 with respect to the plane 48 normal to the surface 38 of the transfer belt 35. That is, the second light-receiving element 44 is disposed in such a manner that the angle of disposition thereof is larger than that of the first light-receiving element 43. In the present embodiment, the angle $A_3$ is set to 25°. It should be noted that in the case where the second light-receiving element 44 is disposed on the side opposite to the light-emitting element 42 with respect to the plane 48 normal to the surface 38 of the transfer belt 35, it is set to have a relationship of $A_3>2A_1$.

With the above configuration, the light reflected from the surface 38 of the transfer belt 35 when no toner visible image 39 is formed thereon can be received in large quantity. In the case where the toner visible image 39 has not completely covered the surface 38 of the transfer belt 35 and the amount of toner of the toner visible image 39 is small as well, the quantity of the light that impinges on and is reflected from the surface 38 of the transfer belt 35, transmitted through the toner layer, can be detected with accuracy. It is thus possible to accurately detect the amount of toner.

Figure 5:
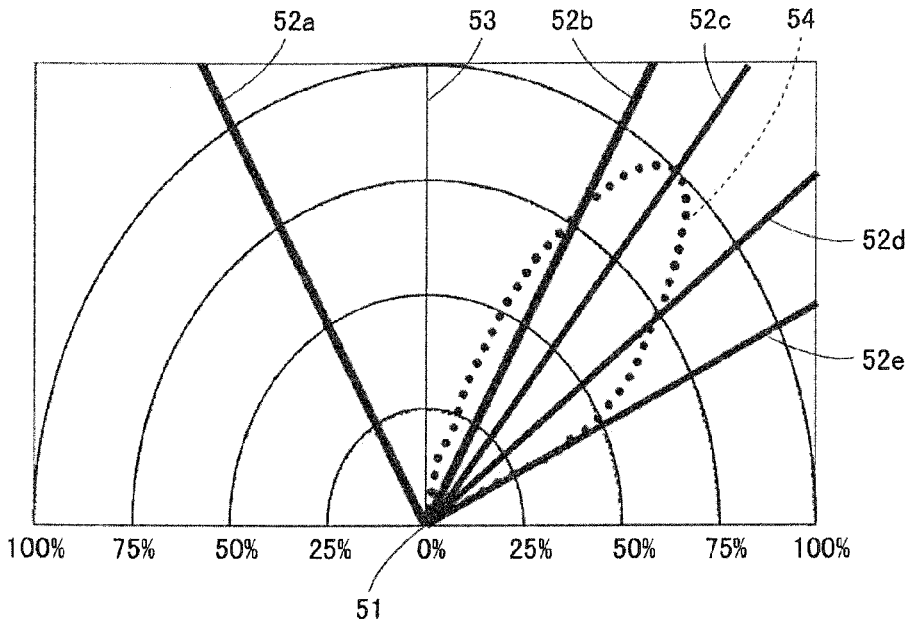
FIG. 5 is a graph diagram showing the relationship between the reflectance of the surface of a transfer belt and the reflection angle of incident light.

This will now be described. FIG. 5 is a graph diagram showing the relationship between the reflectance of the surface 38 of the transfer belt 35 and the reflection angle of incident light. The position with the indication of 0% located at the center 51 in FIG. 5 shows the irradiation position of light. In FIG. 5, concentric semicircles are drawn about the center 51, at the positions corresponding respectively to the reflectance of 25%, 50%, 75%, and 100%. A solid line 52*a* represents incident light, and a solid line 52*b* represents specularly reflected light. The line corresponding to the plane normal to the reflected plane is indicated by a solid line 53. A broken line 54 represents the reflectance of the surface 38 of the transfer belt 35 within a range of certain reflection angles.

Referring to FIG. 5, the angle between the solid lines 52*a* and 53 corresponds to the above-described angle $A_1$, which is set to 30°. The angle between the solid lines 52*b* and 53 also corresponds to the above-described angle $A_1$, which is 30° here. The point of intersection between the solid line 52*b* and the broken line 54 indicates the reflectance when the incident light is reflected specularly, which is about 75%. The reflectance increases gradually as the reflection angle increases from the angle $A_1$. In this case, the reflectance becomes almost 100% when the reflection angle becomes 40° as indicated by the solid line 52*c*. This reflection angle corresponds to the maximum reflectance. Thereafter, the reflectance decreases gradually with increasing reflection angle, and at the reflection angle of 45° as indicated by the solid line 52*d*, the reflectance becomes about 75%, which is approximately the same as the reflectance of the specular reflection. Thus, in terms of the angles $A_1$ and $A_2$, the relationship of $A_1<A_2<1.5A_1$ at least ensures that the light can be received in a position where the reflectance is higher than in the position of the specular reflection. Accordingly, with such a configuration, the light reflected from the surface 38 of the transfer belt 35 when no toner visible image 39 is formed thereon can be received in large quantity. Further in the case where the toner visible image 39 has not completely covered the surface 38 of the transfer belt 35 and the amount of toner of the toner visible image 39 is small, the quantity of light that impinges on and is reflected from the surface 38 of the transfer belt 35, transmitted through the toner layer, can be detected with accuracy. It is thus possible to accurately detect the amount of toner.

This is conceivably for the following reasons. The surface 38 of the transfer belt 35 is covered with a very thin layer of certain coating agent for improving the toner transfer efficiency, protecting the surface 38 of the transfer belt 35, and other purposes. The incident light refracts or scatters depending on the type of the coating agent, the thickness of the coating layer, and the like. Such refraction or scattering of the incident light may possibly cause the above-described tendency that the reflectance becomes greater at angles larger than the specular reflection angle. Examples of the coating agent include polyamide resin, polyamide-imide resin, polyimide resin, and polycarbonate resin.

Therefore, for example with the angle $A_1$ of 30°, the angle $A_2$ may be set to be larger than 30° and less than 45°. This enables light to be received within the range where the reflectance is higher than in the case of the specular reflection. Specifically, the angle $A_2$ is set to 35° or 40°. For this angle $A_2$, an arbitrary value may be selected within the above-described range of larger than 30° and less than 45°, depending on the material of the transfer belt 35 and the like. For example, in the case where the transfer belt 35 is formed of resin including at least one selected from the group of polyamide-imide resin, polyimide resin, and polycarbonate resin, the angle $A_2$ may be set to 35°. In the case where the transfer belt 35 is formed of rubber including at least one of urethane rubber and hydrin rubber, the angle $A_2$ may be set to 40°.

When the reflection angle is further increased from 45° shown by the solid line 52*d*, the angle falls outside the range delimited by the broken line 54, as shown by the solid line 52*e*. When the second light-receiving element 44 which receives diffuse reflection light is disposed at an angle larger than that angle, it can receive the diffuse reflection light efficiently, without being affected by the specular (or near-specular) reflection. The angle between this solid line 52*e* and the solid line 53 is indicated by $2A_1$, which is 60° here.

Regarding the diffuse reflection light, in the case where the second light-receiving element 44 is disposed on the same side as the light-emitting element 42 with respect to the plane 48 normal to the surface 38 of the transfer belt 35, it would hardly be affected by the specular (or near-specular) reflection. Therefore, the device configuration may be determined to have a relationship of $A_3>A_1$. That is, the second light-receiving element 44 may be disposed on the side opposite to the first light-receiving element 43 with respect to the location of the light-emitting element 42.

Figure 6:
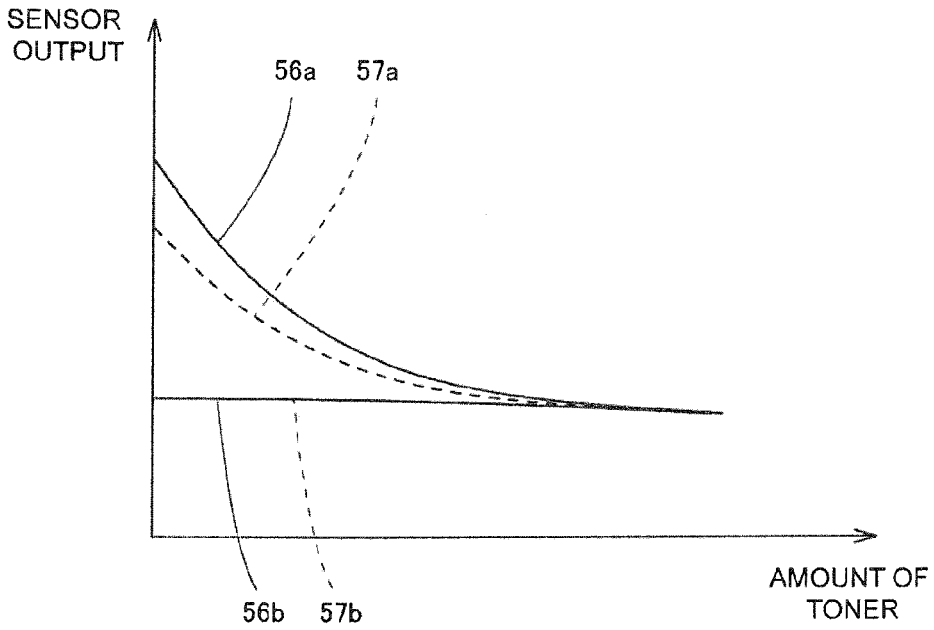
FIG. 6 is a graph diagram showing the relationship between the amount of toner and the output of the toner-amount detection sensor in the case of detecting the toner amount of a black toner visible image.
Figure 7:
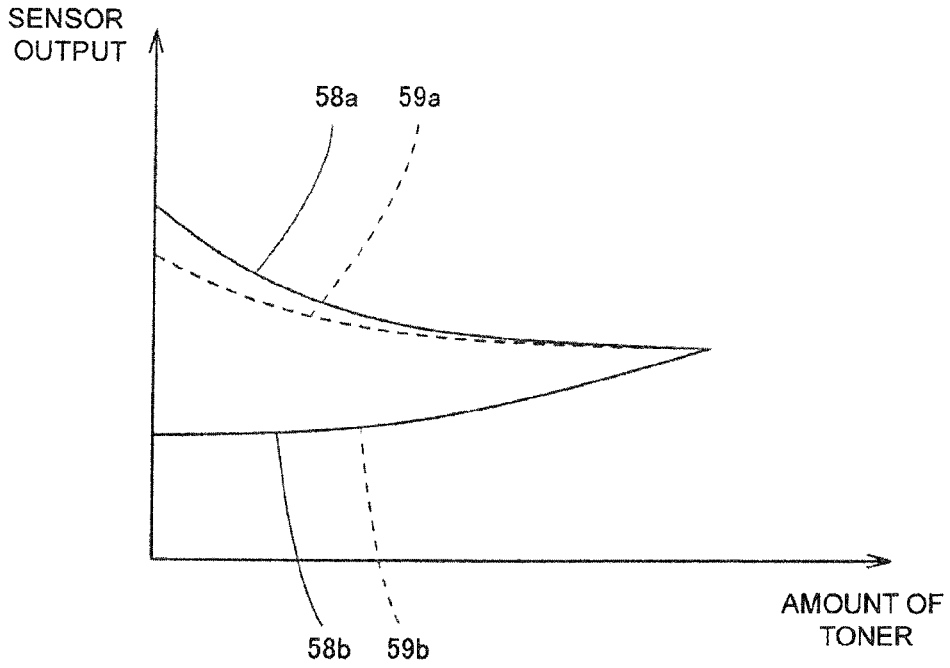
FIG. 7 is a graph diagram showing the relationship between the amount of toner and the output of the toner-amount detection sensor in the case of detecting the toner amount of a yellow toner visible image.

FIG. 6 is a graph diagram showing an approximate relationship between the amount of toner and the output of the toner-amount detection sensor 41 in the case of detecting the toner amount of a black toner visible image 39. FIG. 7 is a graph diagram showing an approximate relationship between the amount of toner and the output of the toner-amount detection sensor 41 in the case of detecting the toner amount of a yellow toner visible image 39. The approximate relationships between the amount of toner and the output of the toner-amount detection sensor 41 in the case of detecting the toner amount of a cyan toner visible image 39 and in the case of detecting the toner amount of a magenta toner visible image 39 are identical to the approximate relationship between the amount of toner and the output of the toner-amount detection sensor 41 in the case of detecting the toner amount of a yellow toner visible image 39, and therefore, the description thereof will be omitted.

In each of FIGS. 6 and 7, the vertical axis represents the output value of the toner-amount detection sensor 41, and the horizontal axis represents the amount of toner. On the vertical axis, the value increases toward the upper side of the paper plane. On the horizontal axis, the value increases toward the right side of the paper plane. In FIG. 6, the upper solid line 56*a* represents the output value which is output on the basis of the quantity of light received by the first light-receiving element 43 in the case where the angle $A_2$ is 40°, and the lower solid line 56*b* represents the output value which is output on the basis of the quantity of light received by the second light-receiving element 44 in the case where the angle $A_2$ is 40°. In FIG. 6, the upper broken line 57*a* represents the output value which is output on the basis of the quantity of light received by the first light-receiving element 43 in the case where the angle $A_2$ is 30°, and the lower broken line 57*b* represents the output value which is output on the basis of the quantity of light received by the second light-receiving element 44 in the case where the angle $A_2$ is 30°. In FIG. 7, the upper solid line 58*a* represents the output value which is output on the basis of the quantity of light received by the first light-receiving element 43 in the case where the angle $A_2$ is 40°, and the lower solid line 58*b* represents the output value which is output on the basis of the quantity of light received by the second light-receiving element 44 in the case where the angle $A_2$ is 40°. In FIG. 7, the upper broken line 59*a* represents the output value which is output on the basis of the quantity of light received by the first light-receiving element 43 in the case where the angle $A_2$ is 30°, and the lower broken line 59*b* represents the output value which is output on the basis of the quantity of light received by the second light-receiving element 44 in the case where the angle $A_2$ is 30°.

Referring first to FIG. 6, in the case of the black toner visible image 39, when the amount of toner is very small and nearly 0, the output value based on the quantity of light received by the first light-receiving element 43 when the angle $A_2$ is 40° takes a large value as compared to the output value based on the quantity of light received by the first light-receiving element 43 when the angle $A_2$ is 30°. As such, in the case where the amount of toner is small, the quantity of the reflected light is larger when the angle $A_2$ is 40°, shown by the solid line 56*a*, as compared to when the angle $A_2$ is 30°, shown by the broken line 57*a*.

It should be noted that the solid line 56*b* represents the output value based on the quantity of light received by the second light-receiving element 44 when the angle $A_3$ is 60°, and the broken line 57*b* represents the output value based on the quantity of light received by the second light-receiving element 44 when the angle $A_3$ is 60°. The output values are almost the same.

Accordingly, the toner-amount detection sensor 41 can accurately detect the amount of toner over a wider output value range, from the state of no toner, or, the state where the surface 38 of the transfer belt 35 is detected with no toner visible image 39 formed thereon, to the state where a small amount of toner is detected with the toner only slightly covering the surface 38 of the transfer belt 35. That is, while the sensor output values ultimately converge to almost the same value in the solid line 56*a* and the broken line 57*a* as the amount of toner increases, the sensor output value when the amount of toner is 0 can be increased in the solid line 56*a*. This ensures accurate detection of the amount of toner.

Referring next to FIG. 7, in the case of the yellow toner visible image 39 as well, when the amount of toner is very small and nearly 0, the output value based on the quantity of light received by the first light-receiving element 43 when the angle $A_2$ is 40° takes a large value as compared to the output value based on the quantity of light received by the first light-receiving element 43 when the angle $A_2$ is 30°. As such, in the case where the amount of toner is small, the quantity of the reflected light is larger when the angle $A_2$ is 40°, shown by the solid line 58*a*, as compared to when the angle $A_2$ is 30°, shown by the broken line 59*a*.

It should be noted that the solid line 58*b* represents the output value based on the quantity of light received by the second light-receiving element 44 when the angle $A_3$ is 60°, and the broken line 59*b* represents the output value based on the quantity of light received by the second light-receiving element 44 when the angle $A_3$ is 60°. The output values are almost the same.

Therefore, according to the toner-amount detection sensor 41 with the above configuration, the light reflected from the surface 38 of the transfer belt 35 can be received in large quantity. It is thus possible to accurately detect the amount of toner. Further, according to the digital multifunctional peripheral 11 with the above configuration, the quality of the image formed can be improved, as the apparatus includes the toner-amount detection sensor 41 which can accurately detect the amount of toner.

In the embodiment described above, the toner-amount detection sensor 41 includes the second light-receiving element which receives diffuse reflection light. The configuration of the sensor, however, is not limited thereto; the second light-receiving element may be omitted if necessary. This can simplify the device configuration.

Further, in the embodiment described above, the light-emitting element may be configured to emit polarized light having a prescribed wavelength. In this case, of the reflected light, polarized light having the prescribed wavelength may be dispersed and received, and the amount of toner may be detected on the basis of the received light.

Figure 8:
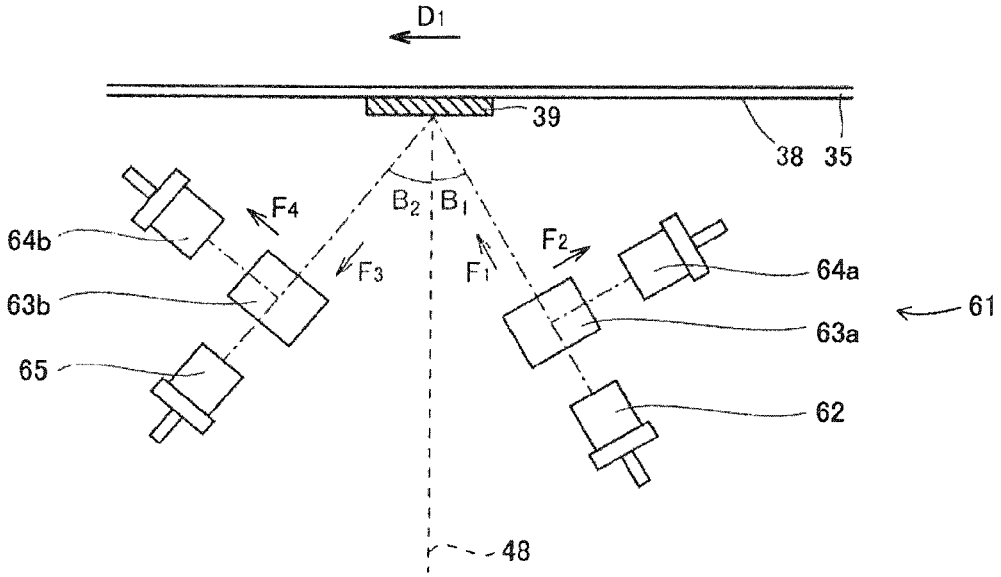
FIG. 8 is an appearance diagram schematically showing the configuration of a toner-amount detection sensor according to another embodiment of the present disclosure.

FIG. 8 shows a toner-amount detection sensor according to another embodiment of the present disclosure. Referring to FIG. 8, this toner-amount detection sensor 61 includes: a light-emitting element 62 which emits light toward a surface 38 of a transfer belt 35 or a toner visible image 39; a first polarization unit 63*a* which disperses the light from the light-emitting element 62 into polarized light of P- and S-polarization and emits the P-polarized light component toward the surface 38 of the transfer belt 35 or the toner visible image 39, as shown by an arrow $F_1$; a first polarized-light-receiving element 64*a* which receives the S-polarized light that was dispersed by the first polarization unit 63*a* in the direction shown by an arrow $F_2$; a second polarization unit 63*b* which receives the light in the direction shown by an arrow $F_3$ from the surface 38 of the transfer belt 35 and/or the toner visible image 39 formed thereon, and disperses the received light into polarized light of P- and S-polarization; a second polarized-light-receiving element 64*b* which receives the S-polarized light that was dispersed by the second polarization unit 63*b* in the direction shown by an arrow $F_4$; a third polarized-light-receiving element 65 which receives the P-polarized light that has passed through the second polarization unit 63*b*; and a toner-amount calculating unit (not shown) which calculates the amount of toner from the quantity of the reflected light received by the third polarized-light-receiving element 65 or the like.

Here, the sensor is configured to have a relationship of $B_1<B_2<1.5B_1$ where $B_1$ is the angle of incidence with respect to a plane 48 normal to the surface 38 of the transfer belt 35, or, the angle of disposition of the light-emitting element 62 with respect to the plane 48 normal to the surface 38 of the transfer belt 35, and $B_2$ is the angle of disposition of the third polarized-light-receiving element 65 with respect to the plane 48 normal to the surface 38 of the transfer belt 35.

With the above configuration, polarized light of P- and S-polarization can be used to detect the amount of toner on the basis of the quantities of those lights. In this case as well, it is of course possible to provide a light-receiving element which receives diffuse reflection light, and the amount of toner may be detected on the basis of the received diffuse reflection light.

It should be noted that in the embodiment described above, polyimide resin was used as the material for the resin transfer belt. The material of the transfer belt, however, is not limited thereto; it may be, for example, any of polyamide-imide resin, polyimide resin, and polycarbonate resin. Further, although urethane rubber was used as the material for the rubber transfer belt, not limited thereto, hydrin rubber may be used as well. That is, at least one of polyamide resin, polyamide-imide resin, polyimide resin, polycarbonate resin, urethane rubber, and hydrin rubber may be included as the material for the transfer belt.

Further, in the above embodiment, the angle $A_1$ may be set to an angle other than that mentioned above.

In the above embodiment, an infrared light-emitting diode was adopted as an example of the light-emitting element, and infrared light-receiving elements were adopted as an example of the first and second light-receiving elements. The elements, however, are not limited thereto; a light-emitting element which emits light having another wavelength, such as visible light, and first and second light-receiving elements which receive light having the other wavelength may be used as well.

Further, although the transfer belt as an intermediate transfer body was used as the transfer body in the above embodiment, not limited thereto, the present disclosure is applicable to the case where the transfer body is a photoreceptor or the like. Further, in the case where the transfer body has a curved surface, the plane normal to the surface of the transfer body, as shown in FIG. 4, is represented by a normal line to the curved surface.

It should be understood that the embodiments disclosed herein are illustrative and non-restrictive in every respect. The scope of the present disclosure is defined by the terms of the claims, rather than the description above, and is intended to include any modifications within the scope and meaning equivalent to the terms of the claims.

The toner-amount detection sensor and the image forming apparatus according to the present disclosure are applicable particularly advantageously to the case where an improvement in image quality of the image formed is required.

What is claimed is:

1. A toner-amount detection sensor for detecting the amount of toner of a toner visible image formed on a surface of a transfer body, comprising:

a light-emitting element configured to emit light toward the surface of the transfer body at a predetermined incident angle;

a first light-receiving element disposed on a side opposite to the light-emitting element with respect to a plane normal to the surface of the transfer body and configured to receive light reflected from the surface of the transfer body; and a toner-amount calculating unit configured to calculate the amount of toner from the quantity of the reflected light received by the first light-receiving element;

the sensor having a relationship of $A_1<A_2<1.5A_1$ where $A_1$ represents the predetermined incident angle with respect to the plane normal to the surface of the transfer body, and $A_2$ represents an angle of disposition of the first light-receiving element with respect to the plane normal to the surface of the transfer body, wherein the angle $A_1$ falls within a range of at least 10° and less than 12°, and the angle $A_2$ falls within a range of at least 12° and less than 18°.

2. The toner-amount detection sensor according to claim 1, further comprising:

a second light-receiving element disposed separately from the first light-receiving element and configured to receive light reflected from the surface of the transfer body, wherein in the case where the second light-receiving element is disposed on the side opposite to the light-emitting element with respect to the plane normal to the surface of the transfer body, the sensor has a relationship of $A_3>2A_1$ where $A_3$ represents an angle of disposition of the second light-receiving element with respect to the plane normal to the surface of the transfer body, and in the case where the second light-receiving element is disposed on the same side as the light-emitting element with respect to the plane normal to the surface of the transfer body, the sensor has a relationship of $A_3>A_1$.

3. The toner-amount detection sensor according to claim 1, wherein the light-emitting element emits polarized light toward the surface of the transfer body, the first light-receiving element receives polarized light of light reflected from the surface of the transfer body, and the toner-amount calculating unit calculates the amount of toner from the quantity of the polarized light of the reflected light received by the first light-receiving element.

4. The toner-amount detection sensor according to claim 1, wherein the light emitted by the light-emitting element includes infrared light.

5. The toner-amount detection sensor according to claim 1, wherein the transfer body includes a transfer belt, and a material of the transfer belt includes at least one of polyamide resin, polyamide-imide resin, polyimide resin, polycarbonate resin, urethane rubber, and hydrin rubber.

6. An image forming apparatus including an image forming unit, the image forming unit forming a visible image with toner and including a toner-amount detection sensor for detecting the amount of toner of the toner visible image formed on a surface of a transfer body, the toner-amount detection sensor comprising:

a light-emitting element configured to emit light toward the surface of the transfer body at a predetermined incident angle;

a first light-receiving element disposed on a side opposite to the light-emitting element with respect to a plane normal to the surface of the transfer body and configured to receive light reflected from the surface of the transfer body; and a toner-amount calculating unit configured to calculate the amount of toner from the quantity of the reflected light received by the first light-receiving element;

the sensor having a relationship of $A_1<A_2<1.5A_1$ where $A_1$ represents the predetermined incident angle with respect to the plane normal to the surface of the transfer body, and $A_2$ represents an angle of disposition of the first light-receiving element with respect to the plane normal to the surface of the transfer body, wherein the angle $A_1$ falls within a range of at least 10° and less than 12°, and the angle $A_2$ falls within a range of at least 12° and less than 18°.

* * * * *